United States Patent [19]

Kusayanagi et al.

[11] 4,427,561

[45] Jan. 24, 1984

[54] SULFUR COMPOUND CONTAINING LUBRICANT COMPOSITION FOR USE IN FLON ATMOSPHERE

[75] Inventors: Sampo Kusayanagi, Yokohama; Ryuji Kimura, Urawa, both of Japan

[73] Assignee: Nippon Mining Co., Ltd., Tokyo, Japan

[21] Appl. No.: 276,291

[22] Filed: Jun. 22, 1981

[30] Foreign Application Priority Data

Jun. 20, 1980 [JP] Japan ..... 55-82872

[51] Int. Cl.[3] ..... C10M 1/38; C10M 1/42; C10M 3/32; C10M 3/36

[52] U.S. Cl. ..... 252/45; 252/48.6; 252/48.2

[58] Field of Search ..... 252/45, 48.6, 48.2

[56] References Cited

U.S. PATENT DOCUMENTS

| | | | |
|---|---|---|---|
| 4,116,812 | 9/1978 | Godar et al. | 252/45 X |
| 4,124,514 | 11/1978 | Yaffe | 252/45 X |
| 4,125,471 | 11/1978 | Vienna et al. | 252/45 X |
| 4,148,737 | 4/1979 | Liston et al. | 252/45 X |
| 4,148,739 | 4/1979 | Liston et al. | 252/45 X |
| 4,163,006 | 7/1979 | Spivack | 252/45 X |
| 4,200,543 | 4/1980 | Liston et al. | 252/45 X |

*Primary Examiner*—Paul F. Shaver

*Attorney, Agent, or Firm*—Sughrue, Mion, Zinn, Macpeak & Seas

[57] ABSTRACT

A lubricant composition that exhibits high wear resistance in a Flon atmosphere is disclosed. The composition comprises mineral oil, alkylbenzene, or a mixture of mineral oil and alkylbenzene as a base oil and it has added thereto an organic sulfur compound in an amount greater than a certain value.

5 Claims, 4 Drawing Figures

SULFUR COMPOUND CONTAINING LUBRICANT COMPOSITION FOR USE IN FLON ATMOSPHERE

FIELD OF THE INVENTION

This invention relates to a lubricant, and more particularly, to a lubricant composition for machines used in Flon atmosphere, such as refrigerating compressor and Flon expanding turbine.

BACKGROUND OF THE INVENTION

Attempts are being made to manufacture smaller, lighter and more energy-saving refrigerators. Today, an increasing number of refrigerators are used throughout the year. Another interesting fact is that reciprocating compressors that have been used in air conditioners for automobiles and houses are being replaced by rotary compressors. All of these phenomena are factors that put frictional and lubricated areas in the compressor (e.g., bearing, piston, seal unit and vane) under severer conditions, and it is important to take care to prevent excessive wear and seizure. More importantly, the friction loss in the lubricated area must be reduced. For these reasons, one requirement for lubricants to be used in refrigerators in Flon atmosphere is that they have good lubricating properties (e.g., wear resistance and seizure resistance) and low viscosity.

One must fully recognize the fact that lubricants for use at lubricated areas in apparatus that are exposed to a sealed Flon atmosphere and other lubricants (e.g., gasoline engine oil, diesel engine oil, industrial lubricants such as cutting oil, hydraulic oil, gear oil and other oils that are used in an oxygen-containing atmosphere such as air) require entirely different design philosophies in improving their lubricating properties such as wear resistance and seizure resistance. The former type must exhibit lubricating properties in Flon atmosphere whereas the latter must have lubricating properties in an oxygen-containing atmosphere. The extreme pressure tests specified in JIS or ASTM (e.g., the four ball test in ASTM D2266-78 or Falex test in ASTM D3233-73) assumes testing in an air atmosphere whether the lubricant under testing is actually used in such atmosphere or not. So, one who looks at the test data is apt to overlook the effect of the testing atmosphere in his evaluation of the performance of the lubricant. Some improvement in the wear resistance and load resistance is achieved by adding certain sulfur compounds (e.g., sulfurized olefin and sulfurized sperm oil) to the lubricant, but natural organic sulfur compounds in mineral oils are not effective for the wear resistance and load resistance.

In our study on the lubricant for use in machines operated in a sealed Flon atmosphere, we have found that the lubricating atmosphere itself has great effect on the wear behavior and that the presence of natural sulfur compound in mineral oils help provide improved wear resistance in a Flon gas atmosphere. Table 1 compares two mineral oils that were desulfurized to different extents and indicates that the presence of sulfur produces a large wear scar in air but that it proves effective against wear in a Flon atmosphere.

TABLE 1

| | Atmosphere | Abrasion Scar (mm) |
|---|---|---|
| Mineral oil (sulfur = 0.03 wt %) | Air | 0.51 |
| Mineral oil (sulfur = 0.03 wt %) | Argon | 0.42 |
| Mineral oil (sulfur = 0.03 wt %) | Flon (R-22) | 0.43 |
| Mineral oil (sulfur = 0.27 wt %) | Air | 0.62 |
| Mineral oil (sulfur = 0.27 wt %) | Argon | 0.38 |
| Mineral oil (sulfur = 0.27 wt %) | Flon (R-22) | 0.28 |

As a result, we have found that the need of lower viscosity that had been considered incompatible with good lubricating properties can be met and a lubricant that retains good lubricating properties down to an extremely low viscosity range can be obtained by modification of sulfur content. This finding is not obvious at all in the prior art and is particularly unique to a Flon atmosphere.

So far, naphthenic mineral oils have been used with advantage as refrigerating oils, but because naphthene base crude oils are not easily available these days, mineral oils derived from more easily available paraffin or mixed base crude oils are preferred. These mineral oils do not have high ability to dissolve Flon at low temperatures, and to solve this problem, Japanese Patent Application (OPI) No. 139608/79 (the term "OPI" as used herein refers to a "published unexamined Japanese patent application") teaches the use of alkylbenzene. It also teaches the use of a phosphite ester for providing improved wear resistance. Japanese Patent Application (OPI) Nos. 54707/77 and 127904/77 teach that alkylbenzene lowers the critical dissolution temperature and provides higher heat resistance. But the lubricating properties, such as wear resistance, of alkylbenzene are not as good as those of mineral oils, and they fail to achieve the desired lubrication in compressor parts. The phosphite ester undergoes hydrolysis in the presence of a trace amount of water.

SUMMARY OF THE INVENTION

The basic concept of this invention is to use the combined effect of natural organic sulfur compounds in mineral oils and specific organic sulfur compounds to effectively lubricate machine components used in a Flon compound-containing atmosphere.

The term "Flon" as used herein is a generic term for halogen substituted compounds containing fluorinated methane or ethane hydrocarbons and having a chemical structure represented by the formula: $C_kH_lCl_mF_n$ (wherein k is an integer of 1 or 2, and $2k+2=l+m+n$). Illustrative Flons are products sold under the trademark "Freon" from Du Pont such as Freon-11 (F-11), Freon-12 (F-12), Freon-13 (F-13), Freon-21 (F-21), Freon-22 (F-22), Freon-113 (F-113), Freon-114 (F-114), Freon-115 (F-115) and Freon-502 (F-502), and equivalents thereof. The Flon R-12 or Flon R-22, for example, is equivalent to Freon F-12 or Freon F-22, respectively, in the chemical composition and properties.

This invention contemplates the following two lubricant compositions:

(1) A lubricant composition for use in a Flon atmosphere comprising a base mineral oil having a lubricating viscosity derived from paraffin, naphthene or mixed base crude oil, said base oil containing an organic sulfur compound to have a total sulfur content of at least 0.14 wt% (this type of lubricant is hereunder referred to as a mineral oil based lubricant composition);

and (2) A lubricant composition for use in a Flon atmosphere comprising as a base oil an alkylbenzene or a mixture thereof with mineral oil, the ratio of alkylbenzene to mineral oil being in a range of from 20:80 to 100:0, said lubricant containing an organic sulfur compound in such an amount that the relation between the total sulfur content in weight percent (S) and the viscosity at 40° C. of the lubricant (Vis in centistokes) satisfies either of the following three formulas:

(i) if Vis is from 5 to 25 cSt:

$$S \geqq -0.022 \times (\text{Vis}) + 0.65;$$

(ii) if Vis is more than 25 cSt and not more than 32 cSt:

$$S \geqq -0.008 \times (\text{Vis}) + 0.30;$$

and (iii) if Vis is more than 32 cSt:

$$S \geqq 0.04$$

(this type of lubricant is hereunder referred to as an alkylbenzene based lubricant composition).

BRIEF DESCRIPTION OF THE DRAWINGS

FIG. 1 is a graph showing the relation between the total sulfur content and the diameter of wear scar resulting in friction test, and in the graph, the circles represent the lubricants that were refined to different sulfur contents, and the crosses represent the lubricants whose total sulfur content was varied by blending a mineral oil of 0.12 wt% sulfur and different amounts of organic sulfur compounds;

FIG. 2 is a graph showing the relation between viscosity and the diameter of wear scar for three different values of total sulfur content;

FIG. 3 is a graph showing the relation between total sulfur content and the diameter of wear scar for a viscosity of 14 to 15 cSt (indicated by a dot) and a viscosity of 30 to 32 cSt (indicated by a cross);

FIG. 4 is a graph showing the minimum necessary level of total sulfur content to achieve good lubrication for a given viscosity, and the area above the curve represents good wear resistance; and FIG. 5 is a graph showing the relation between the diameter of wear scar and the speed of friction tester for the lubricant of this invention and commercial product.

DETAILED DESCRIPTION OF THE INVENTION

The minerals oils used in this invention are hydrocarbon oils produced from paraffin, naphthene or mixed base crude oils by conventional refining methods for producing base oils for lubricants. Being referred to as first, second and third side cuts and also as bright stock, they generally have a viscosity at 40° C. in the range of from about 5 to about 500 cSt (the viscosity at 40° C. is hereunder sometimes indicated by cSt at 40° C.) The refining methods include furfural extraction, hydrofining, and if necessary, dewaxing and clay treatment. Further viscosity modification may be performed by redistillation. It is not particularly necessary that the mineral oils to be used in this invention be highly desulfurized, for the natural sulfur compounds contained have good lubricating properties.

The properties of the mineral oils used in the lubricant composition of this invention are listed in Table 2 below.

TABLE 2

| | | n-d-M Ring Analysis by ASTM D3238-74 | |
|---|---|---|---|
| | Viscosity (cSt at 40° C.) | $C_N$ (%) | $C_A$ (%) |
| Paraffinic mineral oil A | 22.0 | 27.4 | 5.4 |
| Paraffinic mineral oil B | 15.4 | 28.4 | 4.3 |
| Paraffinic mineral oil C | 34.8 | 33.4 | 0.1 |
| Paraffinic mineral oil D | 8.8 | 28.0 | 10.8 |
| Paraffinic mineral oil E | 102.7 | 27.5 | 4.8 |
| Paraffinic mineral oil F | 470 | 22.5 | 8.1 |
| Paraffinic mineral oil G | 5.5 | 29.0 | 14.0 |
| Naphthenic mineral oil A | 54.8 | 43.5 | 14.5 |
| Naphthenic mineral oil B | 32.8 | 46.1 | 2.6 |
| Naphthenic mineral oil C | 29.3 | 44.6 | 13.8 |

The alkylbenzene used in this invention is linear or branched, and one example is alkylbenzene bottoms (heavy alkylate) obtained as a by-product in the production of the material for detergent from lower olefin and benzene. The linear alkylbenzene means an alkylbenzene primarily consisting of a linear alkylbenzene, and the branched alkylbenzene means an alkylbenzene primarily consisting of a branched alkylbenzene. Both linear and branched alkylbenzenes generally have a viscosity of 4 to 50 cSt at 40° C., which correspond to the alkylbenzenes for the Electrical Insulating Oil No. 2 specified by JIS-C2320, and commercially available products may be used depending on the case. The alkylbenzene generally has a total content of 0.01 wt% or less.

The total sulfur content as used in this invention means the amount of sulfur that constitutes the organic sulfur compounds contained in the lubricant composition. So, it is the amount of sulfur contained in the sum of the natural organic sulfur compounds present in the mineral oil or alkylbenzene used as base oil and a separately added organic sulfur compound, and is represented by S wt%. For the purposes of this invention, the sulfur content of the natural organic sulfur compound present in the mineral oil or alkylbenzene need not be distinguished from that of the separately added organic sulfur compound. So, if there is no need of addition of an organic sulfur compound, the total sulfur content of the lubricant composition is accounted for only by the organic sulfur compound naturally occurring in the base oil. The mineral oil based lubricant composition of this invention has a total sulfur content of at least 0.14 wt%, preferably between 0.14 and 0.6 wt%.

FIG. 1 is a graph showing the relation between the total sulfur content and the diameter of wear scars developed in a friction test in a Flon atmosphere, and it explains one reason for the lower limit of the total sulfur content in the mineral oil based lubricant composition of this invention. Details of the method of modifying the total sulfur content in the lubricant composition of this invention will be given hereunder. In FIG. 1, the circles represent the lubricant samples that were refined to different sulfur contents, and the crosses represent the lubricant samples whose total sulfur content was varied by blending a mineral oil of 0.12 wt% and different amounts of certain organic sulfur compounds to be specified hereunder. As the figure shows, when the total sulfur content exceeds 0.13 wt%, wear resistance in a Flon atmosphere is improved greatly, and beyond 0.15 wt%, the high wear resistance is maintained. But a lubricant such as liquid paraffin which was highly desulfurized to a total sulfur content of 0.01 wt% caused seizure that provided a rough surface of the metal under lubrication. For a total sulfur content of less than 0.12 wt%, the diameter of wear scar was between 0.41 and 0.43 mm, but for a content of more than 0.15 wt%, the diameter remained the same within the range of from about 0.28 to 0.31 mm. The difference is from about 20 to 30%, but in terms of the volume of wear scar, the difference is from about 70 to 80%. This shows that the lubricant composition of this invention must have a total sulfur content of at least 0.14 wt%, preferably at least 0.15 wt%. The wear resisting effect of this amount of sulfur is characteristic of lubrication in a Flon atmosphere, and our experimence has shown that the increase in total sulfur content caused larger wear scars in lubrication in an air atmosphere.

Another reason for the lower limit of the total sulfur content is shown graphically in FIG. 2 which depicts the relation between the viscosity of lubricant composition and the diameter of wear scar for three diffeent values of total sulfur content. For the cases indicated by crosses which had a total sulfur content of from about 0.02 to about 0.1 wt% according to the prior art knowledge, appreciable wear took place at a viscosity of less than 100 cSt and seizure occurred at a viscosity of 7 cSt. The lubricant composition having a viscosity of 15 cSt according to ISO-VG 15 developed to wear scar of a diameter of about 0.5 mm. On the other hand, the samples indicated by circles which contained from 0.14 to 0.20 wt% of sulfur developed a wear scar of a diameter of only less than 0.35 mm. This enabled a significant reduction in viscosity. For the cases indicated by triangles that had a sulfur content of more than 0.25 wt%, good wear resistance was exhibited at a viscosity of 5 cSt at 40° C. Therefore, suitable values of total sulfur content and viscosity can be selected according to the operating conditions of a specific refrigerator, and by modifying the total sulfur content, a lubricant of significantly low viscosity can be used in applications where viscosity could not be reduced without compromising wear resistance.

The upper limit of the total sulfur content is determined not by the desired lubricating performance but rather by the need of preventing the deposition of copper (cupper plating) from the cupreous material used in the piping and evaporator of the refrigerator or by the need of preventing an organic sulfur compound from coming out of solution at low temperatures. According to the experiment we conducted, good lubricating properties were exhibited in a Flon atmosphere by lubricants containing up to about 1.0 wt% of sulfur. In a copper deposition test in a Flon atmosphere to measure the amount of copper deposited on the surface of a ferrous material that was lubricated together with a cupreous material by lubricants of different total sulfur contents, no deleterious phenomenon occurred unless the total sulfur content exceeded about 0.6 wt%. Precipitation of an organic sulfur compound takes place only when the organic sulfur content specified hereunder is added to modify the total sulfur content of the lubricant of this invention. At a temperature between ordinary temperatures and about 50° C., the sulfur compound comes out of solution if the total sulfur content exceeds a value between 0.5 and 0.7 wt% although the exact value varies with the type of the sulfur compound and the properties of the mineral oil to which it is added. But in the presence of Flon, Flon dissolves in the lubricant composition to increase the solubility of the sulfur compound and reduce its precipitation. If the viscosity of the lubricant composition is decreased, the solubility of the sulfur compound is increased and its precipitation decreases further. This consideration leads to the conclusion that there is no problem at all if the total sulfur content is between about 0.6 and 0.8 wt% inclusive of the sulfur content naturally occurring in the mineral oil. Therefore, the upper limit of the total sulfur content of the lubricant composition according to this invention is not limited to any particular value in view of lubricating performance, but to prevent copper deposition, it is preferably less than 0.6 wt%.

The alkylbenzene based lubricant composition according to this invention contains alkylbenzene and mineral oil at a weight ratio between 20:80 and 100:0. The alkylbenzene does not provide as high wear resistance as mineral oil but on the other hand, it has higher ability to dissolve Flon at low temperatures. If reasonably high ability to dissolve Flon at low temperatures is desired, less than 80 wt% of mineral oil is preferably mixed with the alkylbenzene. Table 3 below shows the data to support this limitation.

TABLE 3

| | Alkylbenzene/Mineral Oil (weight ratio) | | | |
|---|---|---|---|---|
| | 100/0 | 50/50 | 25/75 | 0/100 |
| Mixed oil:Flon (R-22) | Critical Dissolution Temperature of Flon (°C.) | | | |
| 10:90 | −67 ↓ | −21 | −6 | 7 |
| 20:80 | −67 ↓ | −13 | 4 | 21 |
| 40:60 | −67 ↓ | −22 | 0 | 20 |
| 60:40 | −67 ↓ | −35 | −12 | 8 |

(The lower value is preferable.)

The total sulfur content of the alkylbenzene based lubricant composition according to this invention must satisfy the relation represented by either of the following three formulas, wherein Vis indicates the viscosity of the lubricant as expressed by centistokes (cSt) at 40° C., and S indicates the total sulfur content of the lubricant as expressed by wt%.

(i) if Vis is from 5 to 25 cSt:

$$S \geqq -0.022 \times (Vis) + 0.65;$$

(ii) if Vis is more than 25 and not more than 32 cSt;

$$S \geqq -0.008 \times (Vis) + 0.30;$$

and (iii) if Vis is more than 32 cSt:

$$S \geqq 0.04.$$

The criticality of the formulas (i) to (iii) is shown graphically by FIGS. 3 and 4. FIG. 3 is a graph showing the relation between total sulfur content and the diameter of wear scar developed by a viscosity test in a Flon atmosphere, and the dots represent the lubricant samples having a viscosity in the range of from 14 to 15 cSt and the crosses indicate the samples having a viscosity in the range of from 30 to 32 cSt. One can see from the figure that the total sulfur content required varies with viscosity. FIG. 4 depicts the minimum necessary level of total sulfur content to provide good wear resistance in a wear test wherein the total sulfur content of an alkylbenzene lubricant was varied over a range of from 9 to 50 cSt. It is not known why the presence of an organic sulfur compound in a Flon atmosphere is effective in achieving good wear resistance, but presumably, it is because the heat of local friction generated at the lubricated surface decomposes. Flon and the decomposed Flon form a reaction product with the sulfur compound, and the reaction product may act to improve the wear resistance.

The method of modifying the total sulfur content of the lubricant composition according to this invention is described hereunder. The first method is accomplished by changing the conditions for refining mineral oils. Ordinary paraffin base crude oil, mixed base crude oil or naphthene base crude oil is subjected to atmospheric distillation, and the resulting residual oil is subjected to vacuum distillation to obtain fractions having a boiling point in the range of from 240° to 700° C. (at atm. pressure), and these fractions may be subjected to further distillation according to the viscosity required. Needless to say, fractions having the desired viscosity may be directly obtained from vacuum distillation. Alternatively, the fractions may be subjected to redistillation after they are passed through a refining step to be described hereunder. It is also possible to obtain "bright stock" by solvent-deaspahlting the residual oil from vacuum distillation with propane or the like. The resulting distillate or oils (hereunder referred to as mineral oils) are sent to the conventional desulfurizing steps for lubricants, i.e., solvent extraction and/or hydrogenation, to thereby desulfurize the mineral oils to a desired sulfur content. If necessary, the mineral oils are subjected to clay treatment, solvent dewaxing or sulfuric acid treatment. Clay treatment is effective in selective removal of nitrogen compounds and is particularly preferred for the purpose of providing improved color and heat stability. Solvent dewaxing is performed to lower the flowing point of the mineral oils. For the purposes of this invention, modification of sulfur content is important and to achieve this, proper solvent extraction and/or hydrogenation is important. The order of solvent extraction and hydrogenation is not critical. In solvent extraction, sulfur compounds including a benzene ring, such as thiophene, benzothiophene and dibenzothiophene compounds, are removed with high selectivity, and in hydrogenation, mercaptan or disulfide compounds are removed and at the same time, a nuclear hydrogenated compound such as benzothiophene is produced. Therefore, the type and amount of sulfur compound to be contained or removed can be determined to some extent by controlling the order of solvent extraction and hydrogenation as well as the degree of desulfurization to be achieved in each treatment. In this invention, it does not matter which type of sulfur compound should be contained in the largest amount.

Distillates from Kuwait crude oil that had a sulfur content of about 2.4 wt% and a viscosity of 20 to 30 cSt at 40° C. were subjected to furfural extraction and hydrogenation under the conditions indicated in Table 4. The total sulfur contents and n-d-M ring analysis of the resulting minerals are shown in Table 4.

TABLE 4

| Furfural Ratio (vol %) | Hydrogenation Temperature (°C.) | Total Sulfur Content (wt %) | n-d-M Ring Analysis $C_A$ (%) | $C_N$ (%) |
|---|---|---|---|---|
| 210 | 300 | 0.15 | 3.7 | 30.6 |
| 150 | 300 | 0.24 | 5.0 | 30.2 |
| 330 | 300 | 0.14 | 3.3 | 28.3 |
| 270 | Not treated | 0.69 | 5.8 | 20.4 |

In one embodiment of the first method of modification of total sulfur content, the first mineral oil that has been desulfurized to high extent is blended with the slightly desulfurized second mineral oil. The blend may be mixed with a third mineral oil if required. By so doing, not only the total sulfur content but also the viscosity can be modified. Examples of modificaton of total sulfur content and viscosity using two mineral oils are listed in Table 5 below.

TABLE 5

| | First Mineral Oil | Second Mineral Oil |
|---|---|---|
| Solvent Extraction | | |
| Furfural Ratio (vol %) | 270 | 150 |
| Temperature (°C.) | 100 | 80 |
| Hydrogenation | | |
| $H_2$ Pressure (kg/cm$^2$) | 100 | 35 |
| Temperature (°C.) | 300 | 330 |
| LHSV (hr$^{-1}$) | 2 | 2 |
| Properties | | |
| Viscosity (cSt at 40° C.) | 32 | 8.4 |
| Sulfur Content (wt %) | 0.09 | 0.35 |
| n-d-M Ring Analysis | | |
| $C_A$ (%) | 4.3 | 10.8 |
| $C_N$ (%) | 28.7 | 27.9 |

| Mixing Ratio (vol %) First Mineral Oil | Second Mineral Oil | Total Sulfur Content (Wt %) | Viscosity (cSt at 40° C.) |
|---|---|---|---|
| 100 | 0 | 0.09 | 32 |
| 50 | 50 | 0.21 | 15 |
| 30 | 70 | 0.27 | 12 |
| 0 | 100 | 0.35 | 8 |

The alkylbenzene is a synthetic product and inherently contains little sulfur. Accordingly, it is effective for modification of total sulfur content to blend the alkylbenzene with mineral oil of high sulfur content.

The second method for modification of total sulfur content is to add to the base oil at least one of the organic sulfur compounds of the following three formulas (I), (II) and (III):

(I)

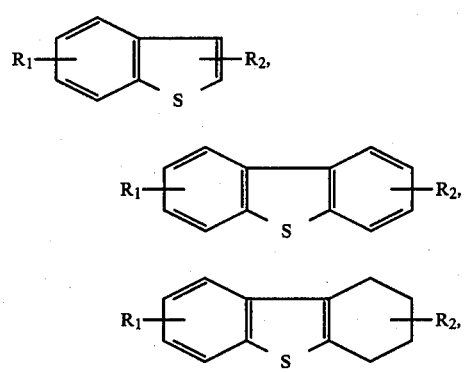

-continued

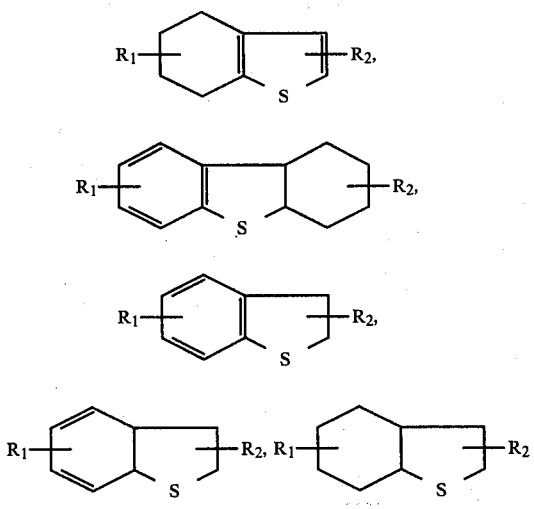

(wherein $R_1$ and $R_2$ which may be the same or different are each an alkyl group having 1 to 8 carbon atoms or hydrogen);

$$R_1—S—R_2 \quad \text{(II)}$$

(wherein $R_1$ and $R_2$ which may be the same or different are each an alkyl group having 4 to 12 carbon atoms, phenyl group, phenol group, benzyl group, naphthalene group or a derivative thereof having an alkyl substituent); and $$[R—O—\overset{\overset{O}{\|}}{C}(CH_2)_n]_2—S \quad \text{(III)}$$

(wherein R is an alkyl group having 4 to 8 carbon atoms or a phenyl group; n is an integer of 2 to 8).

The compounds of the formula (I) have a structure generally referred to as thiophene ring. They include alkyl substituted compounds, as well as benzothiophene having one aromatic ring bonded to the thiophene ring and dibenzothiophene having two aromatic rings bonded to the thiophene ring. The compounds of the formula (II) are generally referred to as sulfide and include aliphatic sulfide, aromatic sulfide, olefinic sulfide and alkyl substituted compounds thereof. A preferred aliphatic sulfide has a boiling point of more than about 200° C. at atmospheric pressure. The compound of the formula (III) is thiocarboxylate.

Dibenzyl disulfide (DBDS) is an organic sulfur compound which does not have the formula (I), (II) or (III). When it is added in a very low concentration, say, 0.01 wt%, it is effective in achieving higher wear resistance but at a concentration of, say, 0.05 wt%, it causes accelerated wear.

As described above, the lubricant composition of this invention achieves good lubrication without using a special extreme-pressure modifier, and at the same time, it is capable of dissolving Flon at low temperatures. Therefore, it is particularly useful in the manufacture of low-viscosity lubricants. The lubricant composition of this invention reduces friction loss and withstands extended service. It is to be understood that the lubricant composition of this invention can be used together with a defoaming agent, other extreme-pressure additives, corrosion inhibitor, etc.

The construction and advantages of this invention are now described in greater detail by reference to the following examples and comparative examples which are given here for illustrative purposes only and are by no means intended to limit the scope of the invention.

EXAMPLES 1 TO 8 AND COMPARATIVE EXAMPLES 1 TO 4

The atmospheric residue of Kuwait crude oil was subjected to vacuum distillation to obtain distillates having a boiling point in the range of from 350° to 550° C. (atm. pressure). The distillates were desulfurized under the conditions indicated in Table 6 and then solvent-dewaxed to produce mineral oils 1, 2, 3, 4 and 5 having a sulfur content between 0.02 and 0.74 wt%. The atmospheric residue of another sample of Kuwait crude oil was subjected to vacuum distillation to obtain distillates having a boiling point in the range of from 250° to 450° C. (atm. pressure). The distillates were hydrogenated and solvent-extracted to produce a mineral oil 6 having a sulfur content of 0.31 wt%. Mineral oil 6 was subjected to vacuum distillation again to give the mineral oil 7 having a viscosity of 5.5 cSt and the mineral oil 8 having a viscosity of 13.0 cSt. The properties of mineral oils 1 to 8 are listed in Table 6. Twelve lubricant compositions having various total sulfur contents were prepared with use of the mineral oil 1, 2, 3, 4, 6 and 7 and liquid paraffin: eleven of them consisted of the mineral oils independently or in admixture in the proportions indicated in Table 8, and the remaining one was liquid paraffin. These compositions were subjected to a friction test under condition A indicated in Table 7. The results are shown in Table 8.

TABLE 6

| | Mineral Oil 1 | Mineral Oil 2 | Mineral Oil 3 | Mineral Oil 4 | Mineral Oil 5 | Mineral Oil 6 | Mineral Oil 7 | Mineral Oil 8 |
|---|---|---|---|---|---|---|---|---|
| Solvent Extraction | | | | | | | | |
| Solvent | Furfural | ← | ← | ← | ← | ← | Light fraction of mineral oil No. 6 redistillation | Heavy fraction of mineral oil No. 6 redistillation |
| Solvent/Oil Ratio (vol) | 2.70 | 2.05 | 2.70 | 2.70 | 2.80 | 1.50 | | |
| Ext. Temp. (°C.) | 75 | 75 | 75 | 75 | 75 | 80 | | |
| Hydrogenation | | | | | | | | |
| Catalyst | Ni—Co—Mo | ← | ← | (not treated) | Ni—Co—Mo | ← | | |
| Reaction Temp. (°C.) | 340 | 320 | 300 | | 340 | 335 | | |
| Pressure (kg/cm$^2$ Gage) | 100 | 100 | 100 | | 100 | 35 | | |
| LHSV (hr$^{-1}$) | 2.4 | 2.4 | 2.4 | | 2.4 | 2.0 | | |
| Sulfur Cont. (wt %) | 0.02 | 0.08 | 0.12 | 0.74 | 0.12 | 0.31 | 0.25 | 0.39 |
| Viscosity (cSt | 32.3 | 32.7 | 31.8 | 32.1 | 102 | 7.5 | 5.5 | 13.0 |

TABLE 6-continued

| | Mineral Oil 1 | Mineral Oil 2 | Mineral Oil 3 | Mineral Oil 4 | Mineral Oil 5 | Mineral Oil 6 | Mineral Oil 7 | Mineral Oil 8 |
|---|---|---|---|---|---|---|---|---|
| at 40° C.) | | | | | | | | |
| n-d-M Ring Analysis | | | | | | | | |
| $C_N$ (%) | 28.8 | 31.5 | 28.5 | 16.9 | 27.5 | 28.0 | 29.0 | 26.6 |
| $C_A$ (%) | 2.9 | 2.8 | 3.8 | 9.2 | 4.8 | 10.8 | 14.0 | 8.0 |
| $C_P$ (%) | 68.3 | 65.7 | 67.7 | 73.9 | 67.7 | 61.2 | 57.0 | 65.4 |

TABLE 7

| Conditions for Friction Test | |
|---|---|
| Apparatus | 4-Ball tester (ASTM-D2266-78) |
| Test Ball | ½ in Cr steel ball |
| Oil Temperature | 25–30° C. |
| Speed | 1,500 rpm |
| Load | 20 kg, 30 kg |
| Operating Period | 30 minutes |
| Atmosphere Gas | Under R-22 or R-12 gas |
| Oil Pretreatment | Purged with R-22 before testing |
| Condition A | 1,500 rpm × 20 kg × 30 min (R-22) |
| Condition B | 1,500 rpm × 30 kg × 10 min (R-12) |
| Wear Evaluation | The diameter of wear scar on the surface of steel ball measured under microscope. The state of worn surface evaluated on the following three-grade basis:<br>A: Almost circular and smooth<br>B: Seizure in the center of the circle<br>C: Generally rectangular dimples on rough surface with seizure |

TABLE 8

| | Sample Mixing Ratio (vol %) | | | | | | |
|---|---|---|---|---|---|---|---|
| | Mineral Oil 1 | Mineral Oil 2 | Mineral Oil 3 | Mineral Oil 4 | Mineral Oil 6 | Liquid Paraffin | Mineral Oil 7 |
| Comparative Example 1 | 100 | | | | | | |
| Comparative Example 2 | | 100 | | | | | |
| Comparative Example 3 | | | 100 | | | | |
| Comparative Example 4 | | | | | | 100 | |
| Example 1 | | | | 100 | | | |
| Example 2 | | | | | 100 | | |
| Example 3 | | | 90 | | 10 | | |
| Example 4 | | | 70 | | 30 | | |
| Example 5 | | | 50 | | 50 | | |
| Example 6 | | | | 50 | 50 | | |
| Example 7 | | 90 | | 10 | | | |
| Example 8 | | | | | | | 100 |

| | Total Sulfur Content (wt %) | Viscosity (cSt at 40° C.) | Diameter of Wear Scar (mm) | Volume of Wear Scar[1] ($mm^3$) | State of Worn Surface |
|---|---|---|---|---|---|
| Comparative Example 1 | 0.02 | 32.3 | 0.43 | $2.33 \times 10^{-4}$ | B |
| Comparative Example 2 | 0.08 | 32.7 | 0.41 | $1.93 \times 10^{-4}$ | A-B |
| Comparative Example 3 | 0.12 | 31.8 | 0.39 | $1.58 \times 10^{-4}$ | A-B |
| Comparative Example 4 | 0.01 | 34.8 | Seizure | — | C |
| Example 1 | 0.74 | 32.1 | 0.30 | $1.58 \times 10^{-5}$ | A |
| Example 2 | 0.31 | 7.5 | 0.30 | $1.58 \times 10^{-5}$ | A |
| Example 3 | 0.14 | 27.2 | 0.32 | $2.04 \times 10^{-5}$ | A |
| Example 4 | 0.17 | 20.6 | 0.29 | $1.38 \times 10^{-5}$ | A |
| Example 5 | 0.21 | 15.5 | 0.30 | $1.58 \times 10^{-5}$ | A |
| Example 6 | 0.52 | 15.8 | 0.30 | $1.58 \times 10^{-5}$ | A |
| Example 7 | 0.15 | 32.0 | 0.31 | $1.80 \times 10^{-5}$ | A |
| Example 8 | 0.25 | 5.5 | 0.38 | $1.54 \times 10^{-4}$ | A-B |

Note

[1]The volume of wear scar was calculated by the following formula described in "A New Aproach in Interpreting the Four Ball Wear Results", Wear., 5, pp. 275–288 (1962).

$$V = \frac{\pi d^4}{64}\left(\frac{1}{R} + \frac{1}{a}\right)$$

V: volume of wear scar ($mm^3$),
d: diameter of wear scar (mm),
R: diameter of steel ball (R = 25.4 mm),
a: radius of curvature of wear scar as determined by the diameter of wear scar and contact pressure.
In Table 8, it is assumed 3,080 mm when d is 0.29–0.32 mm and 10 mm when d is 0.39–0.43 mm.

As shown in Table 8, the diameter of wear scar was between 0.39 and 0.43 mm when the total sulfur content was less than 0.12 wt% and it was reduced to between 0.29 and 0.32 mm when the sulfur content was 0.14 wt% or more. The reduction was about 25%. The volume of wear scar as determined from its diameter was between $1.6\times10^{-4}$ and $2.3\times10^{-4}$ $mm^3$ when the total sulfur content was less than 0.12 wt%, and it was decreased to between $1.4\times10^{-5}$ and $2.0\times10^{-5}$ $mm^3$ when the sulfur content was 0.14 wt% or more. The reduction was about 90%.

EXAMPLE 9 AND COMPARATIVE EXAMPLE 5

Mineral oils 3 and 6 indicated in Table 6 were mixed at a ratio of 65:35 (v/v %) and the mixture was subjected to clay treatment. The resulting lubricant composition (Sample A) was subjected to a friction test in Flon gas (R-12) by changing the speed of the friction tester in a range of from 500 to 7,000 rpm. As a comparison, a commercial refrigerating oil (Commercial Product A) was also tested. The properties of the two samples are listed in Table 9, and the results of the friction test are shown in FIG. 5. In spite of its lower viscosity, Sample A (indicated by dot) exhibited good wear resistance (anti-wear performance) in a high rpm range as well as in a low rpm range in comparison with Commercial Product A (indicated by circle).

TABLE 9

| | Example 9 | Comparative Example 5 |
|---|---|---|
| Sample | Sample A | Commercial Product A |
| Specific Gravity (15/4° C.) | 0.8612 | 0.9160 |
| Viscosity (cSt at 40° C.) | 15.0 | 30.6 |
| Flowing Point (°C.) | −30.0 | −40.0 |
| $C_N$ (%) | 6.2 | 13.9 |
| $C_A$ (%) | 65.4 | 43.0 |
| Total Sulfur Content (wt %) | 0.19 | 0.04 |

EXAMPLES 10 TO 22 AND COMPARATIVE EXAMPLES 6 TO 11

Mineral oil 2 identified in Table 6 and naphthenic mineral oil ($C_N$=43.3%, $C_A$=13.8%, viscosity=33.6 cSt at 40° C.) were blended with dibenzothiophene, benzothiophene, dibutyl sulfide, didodecyl sulfide, diphenyl sulfide, dibenzyl sulfide, 4,4'-thiobis(3-methyl-6-t-butyl)phenol, dilauryl thiodipropionate and dibenzyl disulfide. The resulting lubricant samples having their total sulfur contents modified to various levels were subjected to a friction test under condition A indicated in Table 7. The results are shown in Table 10.

EXAMPLES 23 TO 28 AND COMPARATIVE EXAMPLES 12 AND 13

Mineral oil 7 identified in Table 6 was blended with alkylbenzene at a volume ratio of 30:70 to prepare eight lubricant compositions having a viscosity of 15.0 cSt at 40° C. and a sulfur content of 0.07 wt%. Seven of them were added (mixed) with one of the organic sulfur compounds listed in Table 11. The alkylbenzene was commercialy available from Mitsubishi Petrochemical Co., Ltd. It was the heavy alkylate that was obtained as a by-product in the production of straight chain monoalkylbenzene from α-olefin and benzene and which primarily consisted of dialkylbenzene. Its properties were as follow: sulfur content=less than 0.01 wt%, viscosity=34.7 cSt at 40° C., n-d-M ring analysis=15.1% $C_N$, 18.9% $C_A$. The samples having various total sulfur contents were subjected to a friction test under condition B indicated in Table 7. The results are shown in Table 11.

TABLE 10

| | Mineral Oil | Organic Sulfur Compound Name | Organic Sulfur Compound Addition (wt %) | Total Sulfur Content (wt %) | Result of Friction test: Diameter of Wear Scar (mm) | Result of Friction test: State of Surface |
|---|---|---|---|---|---|---|
| Comparative Example 6 | Paraffinic | (Not added) | — | 0.12 | 0.42 | A-B |
| Example 10 | " | Dibenzothiophene | 0.05 | 0.17 | 0.29 | A |
| Example 11 | " | Benzothiophene | 0.05 | 0.17 | 0.30 | A |
| Example 12 | " | Dibutyl sulfide | 0.05 | 0.17 | 0.28 | A |
| Example 13 | " | Didodecyl sulfide | 0.02 | 0.14 | 0.31 | A |
| Example 14 | " | " | 0.05 | 0.17 | 0.29 | A |
| Example 15 | " | " | 0.30 | 0.42 | 0.30 | A |
| Example 16 | " | Diphenyl sulfide | 0.05 | 0.17 | 0.30 | A |
| Example 17 | " | Dibenzyl sulfide | 0.05 | 0.17 | 0.29 | A |
| Example 18 | " | 4,4'-Thiobis(3-methyl-6-t-butyl)phenol | 0.05 | 0.17 | 0.30 | A |
| Example 19 | " | Dilauryl thiodipropionate | 0.05 | 0.17 | 0.32 | A |
| Comparative Example 7 | " | Dibenzyl disulfide | 0.01 | 0.13 | 0.37 | A-B |
| Comparative Example 8 | " | " | 0.30 | 0.42 | 0.46 | C |
| Comparative Example 9 | " | Dibenzothiophene | 0.01 | 0.13 | 0.37 | B |
| Comparative Example 10 | " | Didodecyl sulfide | 0.01 | 0.13 | 0.35 | B |
| Comparative Example 11 | Naphthenic | (Not added) | — | 0.07 | 0.41 | A-B |
| Example 20 | " | Benzothiophene | 0.10 | 0.17 | 0.30 | A |
| Example 21 | " | Dibenzyl sulfide | 0.10 | 0.17 | 0.31 | A |
| Example 22 | " | Didodecyl sulfide | 0.30 | 0.37 | 0.29 | A |

TABLE 11

| | Comp. Ex. 12 | Comp. Ex. 13 | Ex. 23 | Ex. 24 | Ex. 25 | Ex. 26 | Ex. 27 | Ex. 28 |
|---|---|---|---|---|---|---|---|---|
| Sample | No. 1 | No. 2 | No. 3 | No. 4 | No. 5 | No. 6 | No. 7 | No. 8 |
| Organic Sulfur Compound Added | | | | | | | | |
| Di-n-dodecyl sulfide | (no addition) | 0.10 | 0.25 | 0.35 | | | | |
| Dibenzothiophene | | | | | 0.30 | | | 0.20 |
| Dilauryl thiopropionate | | | | | | 0.30 | | |
| Benzothiophene | | | | | | | 0.30 | |
| Total sulfur content (wt %) | 0.06 | 0.16 | 0.31 | 0.41 | 0.36 | 0.36 | 0.36 | 0.26 |
| Diameter of wear scar (mm) | 0.42 | 0.40 | 0.34 | 0.31 | 0.31 | 0.30 | 0.32 | 0.34 |
| State of surface | B-C | B | B | A | A | A | A | B |

As shown in Table 10, good wear resistance was exhibited when the total sulfur content was more than 0.30 wt% in the case of alkylbenzene and mineral oil mixture of viscosity 15.0 cSt.

EXAMPLES 29 TO 37, COMPARATIVE EXAMPLES 14 TO 20 AND REFERENCE EXAMPLE

Mineral oils 3, 5, 6 and 7 identified in Table 6 were blended with alkylbenzene (the same as used in Examples 23 to 28 and Comparative Examples 12 and 13), and except for Comparative Examples 15, 18, 19 and 20, Example 33 and Reference Example, the blends were mixed with the organic sulfur compounds indicated in Table 12. The Reference Example was commercial naphthene base refrigerating oil. The lubricants having their viscosity and total sulfur contents controlled to various levels were subjected to a friction test under condition A identified in Table 7. The results are shown in Table 12. In Examples 30 and 33 and Comparative Examples 15, 16 and 19, the samples were also subjected to a friction test in an air atmosphere replacing with R-22 atmosphere. As shown in Table 12, adequate control of total sulfur contents gave excellent anti-wear performance in the range of viscosity 7.7 cSt to 52 cSt of lubricants. Diameter of wear scar increased, as the total sulfur contents increase in the air atmosphere, and also the states of metal surface were darkened, black and rough with corrosive seizure.

TABLE 12

| | Comp. Ex. 14 | Ex. 29 | Comp. Ex. 15 | Comp. Ex. 16 | Comp. Ex. 17 | Ex. 30 | Ex. 31 | Comp. Ex. 18 | Ex. 32 |
|---|---|---|---|---|---|---|---|---|---|
| Sample No. | No. 9 | No. 10 | No. 11 | No. 12 | No. 13 | No. 14 | No. 15 | No. 16 | No. 17 |
| Mixing Ratio (wt %) | | | | | | | | | |
| Alkylbenzene | 30 | ← | 50 | ← | ← | ← | ← | 75 | ← |
| Mineral Oil 6 | 70 | ← | | | | | | | |
| Mineral Oil 3 | | | | | | | | 25 | ← |
| Mineral Oil 5 | | | | | | | | | |
| Mineral Oil 7 | | | 50 | ← | ← | ← | ← | | |
| Organic Sulfur Compound (S wt %) | | | | | | | | | |
| Di-n-dodecyl sulfide | 0.20 | 0.40 | | 0.10 | 0.20 | 0.30 | | | |
| Dibenzothiophene | | | | | | | 0.30 | | |
| Dibenzyl sulfide | | | | | | | | | 0.05 |
| Viscosity (cSt at 40° C.) | 10.4 | ← | 13.8 | ← | ← | ← | ← | 32.3 | ← |
| Total Sulfur Content (wt %) | 0.28 | 0.48 | 0.13 | 0.23 | 0.33 | 0.43 | 0.43 | 0.03 | 0.08 |
| Test in R-22 Atmosphere | | | | | | | | | |
| Wear scar (mm) | 0.38 | 0.31 | 0.42 | 0.40 | 0.35 | 0.31 | 0.31 | 0.33 | 0.30 |
| State of surface | B | A | B-C | B | B | A | A | A | A |
| Test in Air Atmosphere | | | | | | | | | |
| Wear scar (mm) | | | 0.65 | 0.66 | | 0.89 | | | |
| State of surface | | | C | C | | C | | | |

| | Ref. Ex. | Ex. 33 | Comp. Ex. 19 | Ex. 34 | Ex. 35 | Comp. Ex. 20 | Ex. 36 | Ex. 37 |
|---|---|---|---|---|---|---|---|---|
| Sample No. | Commercial naphthene base refrigerating oil | No. 18 | No. 19 | No. 20 | No. 21 | No. 22 | No. 23 | No. 24 |
| Mixing Ratio (wt %) | | | | | | | | |
| Alkylbenzene | | 50 | 100 | ← | ← | 70 | ← | 20 |
| Mineral Oil 6 | | | | | | 20 | ← | 20 |
| Mineral Oil 3 | | | | | | 10 | ← | |
| Mineral Oil 5 | | 50 | | | | | | |
| Mineral Oil 7 | | | | | | | | 60 |
| Organic Sulfur Compound (S wt %) | | | | | | | | |
| Di-n-dodecyl sulfide | | | | 0.05 | 0.10 | | | 0.30 |
| Dibenzothiophene | | | | | | | | |
| Dibenzylsulfide | | | | | | | 0.10 | |
| Viscosity (cSt at 40° C.) | 30.6 | 52.0 | 34.7 | ← | ← | 21.5 | ← | 7.7 |
| Total Sulfur Content (wt %) | 0.04 | 0.06 | 0.01 ↓ | 0.05 | 0.10 | 0.07 | 0.17 | 0.15 |
| Test in R-22 Atmosphere | | | | | | | | |
| Wear scar (mm) | 0.35 | 0.32 | 0.42 | 0.31 | 0.30 | 0.40 | 0.32 | 0.31 |
| State of surface | B | A | C | A | A | B | A | A |

TABLE 12-continued

| | | |
|---|---|---|
| Test in Air Atmosphere | | |
| Wear scar (mm) | 0.46 | 0.54 |
| State of surface | C | C |

EXAMPLE 38

Mineral oils 6 and 7 identified in Table 6 were blended with alkylbenzene (the same used in Examples 23 to 28) to prepare oils of Sample Nos. 19, 20 and 21 indicated in Table 13. The critical solution temperature of each of the oils was measured in the following manner.

Measurement of Critical Solution Temperature

A mixture of a sample oil and a cooling medium (R-22) in a weight proportion of 1:9 to 8:2 was charged into a glass tube having an inside diameter of 6 mm and a length of 250 mm, and the glass tube was tightly sealed. The glass tube was shaken at room temperature to allow the mixture to completely mix, and then, the resulting mixture was cooled at a rate of 1° C./min. Thus, the temperature at which the mixture initiated to become cloudy or phase separation initiated was measured.

The results obtained are shown in Table 13.

TABLE 13

| | Sample No. | | |
|---|---|---|---|
| | 19 | 20 | 21 |
| Mixing Ratio of Basic Oils (vol %) | | | |
| Mineral Oil 7 | | | 25 |
| Mineral Oil 6 | 100 | 75 | |
| Alkylbenzene | | 25 | 75 |
| Viscosity (cSt at 40° C.) | 13.0 | 17.5 | 19.0 |
| Critical Solution Temperature (°C.) | | | |
| Ratio of oil to R-22 | | | |
| 1:9 | −20 | −29 | −42 |
| 2:8 | −10 | −20 | −42 |
| 4:6 | −10 | −24 | −42 |
| 6:4 | −20 | −34 | −45 |
| 8:2 | −34 | −38 | −45 |

As is clear from Table 13, Sample Nos. 20 and 21 had an excellent property in Flon-dissolution as compared to Sample No. 19.

While the invention has been described in detail and with reference to specific embodiments thereof, it will be apparent to one skilled in the art that various changes and modifications can be made therein without departing from the spirit and scope thereof.

What is claimed is:

1. A method for lubrication of machines used in a sealed Flon atmosphere substantially devoid of oxygen, which process comprises using a lubricant composition comprising mineral oil as a base oil, said composition containing at least one organic sulfur compound selected from the group consisting of the compounds of the following three formulae (I), (II) and (III):

(I)

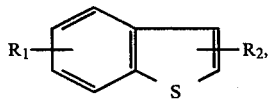

-continued

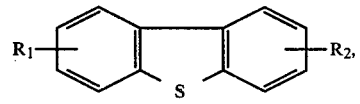

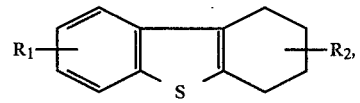

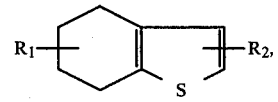

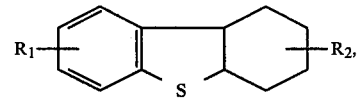

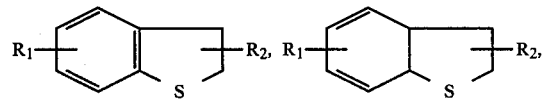

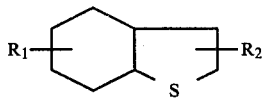

(wherein $R_1$ and $R_2$ which may be the same or different are each an alkyl group having 1 to 8 carbon atoms or hydrogen);

$$R_1—S—R_2 \quad \text{(II)}$$

(wherein $R_1$ and $R_2$ which may be the same or different are each an alkyl group having 4 to 12 carbon atoms, phenyl group, phenol group, benzyl group, naphthalene group or a derivative thereof having an alkyl substituent); and $$[R—O—\overset{\overset{O}{\|}}{C}\cancel{(}CH_2\cancel{)_n}\cancel{]_2}—S \quad \text{(III)}$$

(wherein R is an alkyl group having 4 to 8 carbon atoms or a phenyl group; and n is an integer of 2 to 8), said composition having a total sulfur content of from 0.14 to 0.6 wt%.

2. A method for lubrication of machines used in a sealed Flon atmosphere substantially devoid of oxygen, said process comprising using a lubricant composition comprising an alkylbenzene or a mixture of an alkylbenzene and a mineral oil as a base oil, said composition containing at least one organic sulfur compound selected from the group consisting of the compounds of the following three formulae (I), (II) and (III):

(I)

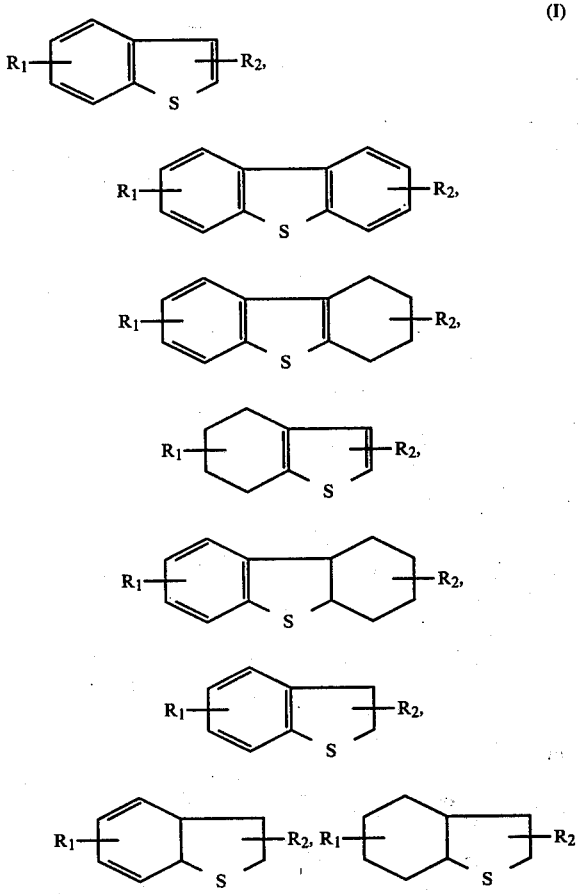

(wherein $R_1$ and $R_2$ which may be the same or different are each an alkyl group having 1 to 8 carbon atoms or hydrogen);

$$R_1—S—R_2 \quad \text{(II)}$$

(wherein $R_1$ and $R_2$ which may be the same or different are each an alkyl group having 4 to 12 carbon atoms, phenyl group, phenol group, benzyl group, naphthalene group or a derivative thereof having an alkyl substituent); and $$[R—O—\overset{O}{\overset{\|}{C}}(CH_2)_n]_2—S \quad \text{(III)}$$

(wherein R is an alkyl group having 4 to 8 carbon atoms or a phenyl group; and n is an integer of 2 to 8), in such an amount that the relation between the total sulfur content in weight percent (S) and the viscosity at 40° C. of said composition (Vis in centistokes) satisfies either of the following three formulas:

(i) if Vis is from 5 to 25 centistokes:

$$S \geqq -0.022 \times (Vis) + 0.65;$$

(ii) if Vis is more than 25 centistokes and not more than 32 centistokes:

$$S \geqq -0.008 \times (Vis) + 0.30;$$

and (iii) if Vis is more than 32 centistokes: $S \geqq 0.04$.

3. A process according to claim 1 wherein said lubricant composition has a viscosity between 5 and 500 centistokes at 40° C., the proportion of naphthenic carbon ($C_N$) being from 20 to 48 wt% and that of aromatic carbon ($C_A$) being less than 20 wt%.

4. A process according to claim 2 wherein said lubricant composition has a viscosity between 7 and 32 centistokes at 40° C., the alkylbenzene being mixed with mineral oil at a weight ratio between 20:80 and 100:0.

5. A process according to claim 1 or 2 wherein the total sulfur content of the lubricant composition is modified by an organic sulfur compound naturally occurring in the mineral oil and by addition of at least one of the organic sulfur compounds of the formula (I), (II) and (III):

(I)

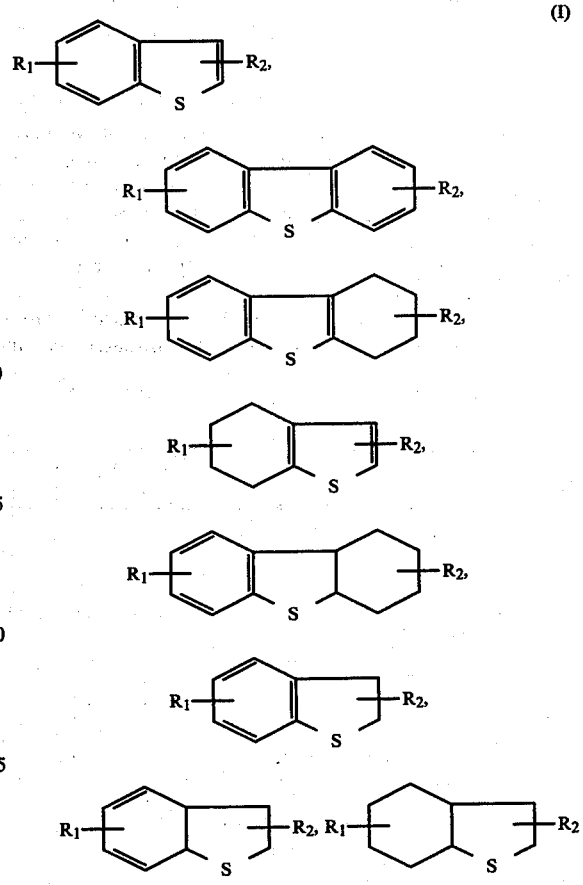

(wherein $R_1$ and $R_2$ which may be the same or different are each an alkyl group having 1 to 8 carbon atoms or hydrogen);

$$R_1—S—R_2 \quad \text{(II)}$$

(wherein $R_1$ and $R_2$ which may be the same or different are each an alkyl group having 4 to 12 carbon atoms, phenyl group, phenol group, benzyl group, naphthalene group or a derivative thereof having an alkyl substituent); and $$[R—O—\overset{O}{\overset{\|}{C}}(CH_2)_n]_2—S \quad \text{(III)}$$

(wherein R is an alkyl group having 4 to 8 carbon atoms or a phenyl group; n is an integer of 2 to 8).

* * * * *